United States Patent [19]

Fangmeier et al.

[11] 4,047,418

[45] Sept. 13, 1977

[54] COMBINED DRAWING AND STRAIGHTENING MACHINE FOR METALLIC TUBES OR RODS

[75] Inventors: Ralf Fangmeier; Alfons Goeke, both of Solingen, Germany

[73] Assignee: Kieserling & Albrecht, Solingen, Germany

[21] Appl. No.: 399,820

[22] Filed: Sept. 24, 1973

[30] Foreign Application Priority Data

Oct. 12, 1972 Germany ..... 2249994

[51] Int. Cl.[2] ..... B21C 1/16; B21D 3/00

[52] U.S. Cl. ..... 72/278; 72/79

[58] Field of Search ..... 72/278, 281, 285, 467, 72/468, 40, 79, 68, 282, 77

[56] References Cited

U.S. PATENT DOCUMENTS

| | | | |
|---|---|---|---|
| 1,847,454 | 3/1932 | Webb | 72/79 |
| 1,933,433 | 10/1933 | Hjelm | 72/79 |
| 2,088,040 | 7/1937 | Simons et al. | 72/282 |
| 2,310,916 | 2/1943 | Gaines et al. | 72/278 |
| 3,080,962 | 3/1963 | Fleischmann | 72/282 |
| 3,181,325 | 5/1965 | Cecchin | 72/43 |
| 3,264,855 | 8/1966 | Turbett | 72/79 |

FOREIGN PATENT DOCUMENTS

| | | | |
|---|---|---|---|
| 939,118 | 11/1948 | France | 72/79 |
| 691,174 | 4/1940 | Germany | 72/79 |
| 1,034,576 | 7/1958 | Germany | 72/79 |
| 710,219 | 6/1954 | United Kingdom | 72/68 |

*Primary Examiner*—Michael J. Keenan
*Attorney, Agent, or Firm*—Michael J. Striker

[57] ABSTRACT

Machine for simultaneous reduction and straightening of metallic tubes or rods has a reducing die which is mounted in the frame downstream of a guide for workpieces and upstream of a ring-shaped straightening tool whose axis orbits about the axis of the opening in the die. The outlet end of the internal surface surrounding the opening in the die tapers counter to the direction of lengthwise movement of workpieces through the die. The guide insures that the workpieces cannot be flexed upstream of the throat portion of the internal surface of the die, and a second guide can be provided downstream of the straightening tool to confine the flexing of the workpieces to the region between the throat portion of the internal surface of the die and the second guide. The tool is mounted in a spherical bearing which is installed in the eccentric bore of a sleeve driven by a pulley to rotate about the axis of the die whereby the tool orbits the axis of its passage about the axis of the opening in the die.

11 Claims, 2 Drawing Figures

COMBINED DRAWING AND STRAIGHTENING MACHINE FOR METALLIC TUBES OR RODS

BACKGROUND OF THE INVENTION

The present invention relates to machines for drawing metallic rods or tubes, and more particularly to improvements in combined drawing and straightening machines for rod-shaped or tubular metallic stock. Still more particularly, the invention relates to improvements in draw benches wherein the stock moves lengthwise and is treated by one or more reducing dies.

It is already known to provide a draw bench with means for effecting at least some straightening of tubular or metallic workpieces simultaneously with a reduction of the diameter. For example, German Pat. No. 977,295 discloses a drawing machine wherein the reducing die is located downstream of a ring which is movable radially to a number of different positions but remains at a standstill once it assumes a selected position. The ring cooperates with the reducing die to produce a certain straightening effect. However, each adjustment of the ring takes up a substantial amount of time, mainly because the final adjustment must be arrived at on the basis of trail and error. Thus, it is necessary to draw a rod or tube through the reducing die and to observe the straightening action or the absence of straightening action of the ring. If the operator determines that the workpiece is being flexed in a given direction, the ring is shifted radially of the reducing die in the opposite direction and the trial is repeated in order to determine the extent of straightening action of the ring in its new position. As a rule, the ring must be adjusted at least twice so that the total time which elapses for a satisfactory adjustment is much too long for an economical drawing and straightening operation. Furthermore, even an optimum adjustment of the ring cannot eliminate at least some flexing of the reduced workpiece so that the latter must be subjected to a costly and time-consuming secondary straightening action. Still further, the just described ring is incapable of furnishing a satisfactory straightening action if the characteristics of the workpiece are not identical in each and every increment thereof; for example, changes in strength of successive increments of a rod-shaped or tubular workpiece, as well as changes in wall thickness of at tubular workpiece are likely to greatly affect the staightening action. Such changes cannot be observed as the workpiece passes through the draw bench so that the final product is bent in spite of placing of the straightening ring in an optimum position with respect to the reducing die. Therefore, many plants employing draw benches prefer to dispense with the straightening ring, especially for the drawing of relatively small numbers of workpieces, because the time spent for proper adjustment of the ring plus the time spent for secondary straightening of workpieces would render the operation uneconomical. Such smaller lots are normally treated in a draw bench without any straightening means and are thereupon introduced into a conventional straightening machine.

The publication "Steel in the USSR" (July 1971, pages 558–559) discloses a combined draw bench and straightening machine wherein the straightening means comprises two concentric axially movable guide sleeves one of which is located upstream and the other of which is located downstream of an orbiting reducing die. A drawback of such proposal is that the reducing must orbit about the common axis of the two guide sleeves and that it must be installed in one or more thrust bearings which take up stresses arising when a workpiece is being pulled through the reducing die. This means that the draw bench must employ very large, bulky and highly expensive thrust bearings. The initial and maintenance cost is further increased due to the fact that the draw bench must be equipped with precision finished adjusting means for changing the eccentricity of the reducing die. Such draw benches cannot be used for the treatment of tubular stock whose internal diameter is determined by a suitable mandrel because the mandrel in the interior of the tubular workpiece would have to move sideways in response to orbital movement of the reducing die.

SUMMARY OF THE INVENTION

An object of the invention is to provide a draw bench which embodies a novel and improved straightening mechanism and wherein the reducing die need not orbit in its frame.

Another object of the invention is to provide novel and improved straightening means which can be incorporated in existing draw benches at a minimal cost and with a minimum of alterations.

A further object of the invention is to provide a combined drawing and straightening machine for tubular or rod-shaped metallic stock wherein the straightening action is sufficiently reliable and reproducible to insure that each and every workpiece whose diameter has been reduced in one or more passes is ready to undergo a further treatment which can be carried out only upon straight workpieces.

An additional object of the invention is to provide a machine of the just outlined character whose straightening action is sufficiently pronounced to insure a highly reliable straightening of relatively short, medium long or very long workpieces so that the workpieces can be automatically transported to a further processing station without any secondary straightening.

Still another object of the invention is to provide a combined straightening and reducing machine whose space requirements need not appreciably exceed the space requirements of a conventional draw bench and wherein the straightening action is not adversely affected by the fact that the length of treated workpieces between the customary grippers or tongs and the reducing die or dies increases while the workpieces are being pulled through one or more reducing dies.

The invention is embodied in a machine for simultaneous reduction and straightening of elongated tubular or rod-shaped metallic workpieces. The machine comprises a frame, a reducing die mounted in the frame and having an open-ended reducing opening or bore for workpieces and an internal surface surrounding the opening and having an intermediate or throat portion and an outline portion which is of conical shape and tapers counter to the direction of lengthwise movement of workpieces through the opening, an annular straightening tool movably mounted in the frame downstream of the die in such a way that it does not rotate about its own axis due to engagement of its internal surface with the workpiece which moves lengthwise through the axial passage of the tool, and means for moving the tool relative to the frame so that the axis of the passage in the tool orbits about the axis of the die opening whereby a workpiece moving lengthwise through the die is flexed by the tool in a plurality of directions in the region downstream of the throat portion of the internal surface of the die.

The apparatus preferably further comprises guide means which is installed in the frame upstream of the die and serves to prevent any appreciable flexing of workpieces between such guide means and the throat portion of the internal surface of the die. Second guide means may be provided downstream of the straightening tool to maintain the portion of a workpiece passing therethrough in axial alignment with that portion of the workpiece which passes through the throat portion of the internal surface of the die. The second guide means cooperates with the die to insure that the flexing workpieces is confined to the region immediately adjacent to both sides of the tool, i.e., to the region between the die and the second guide means.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
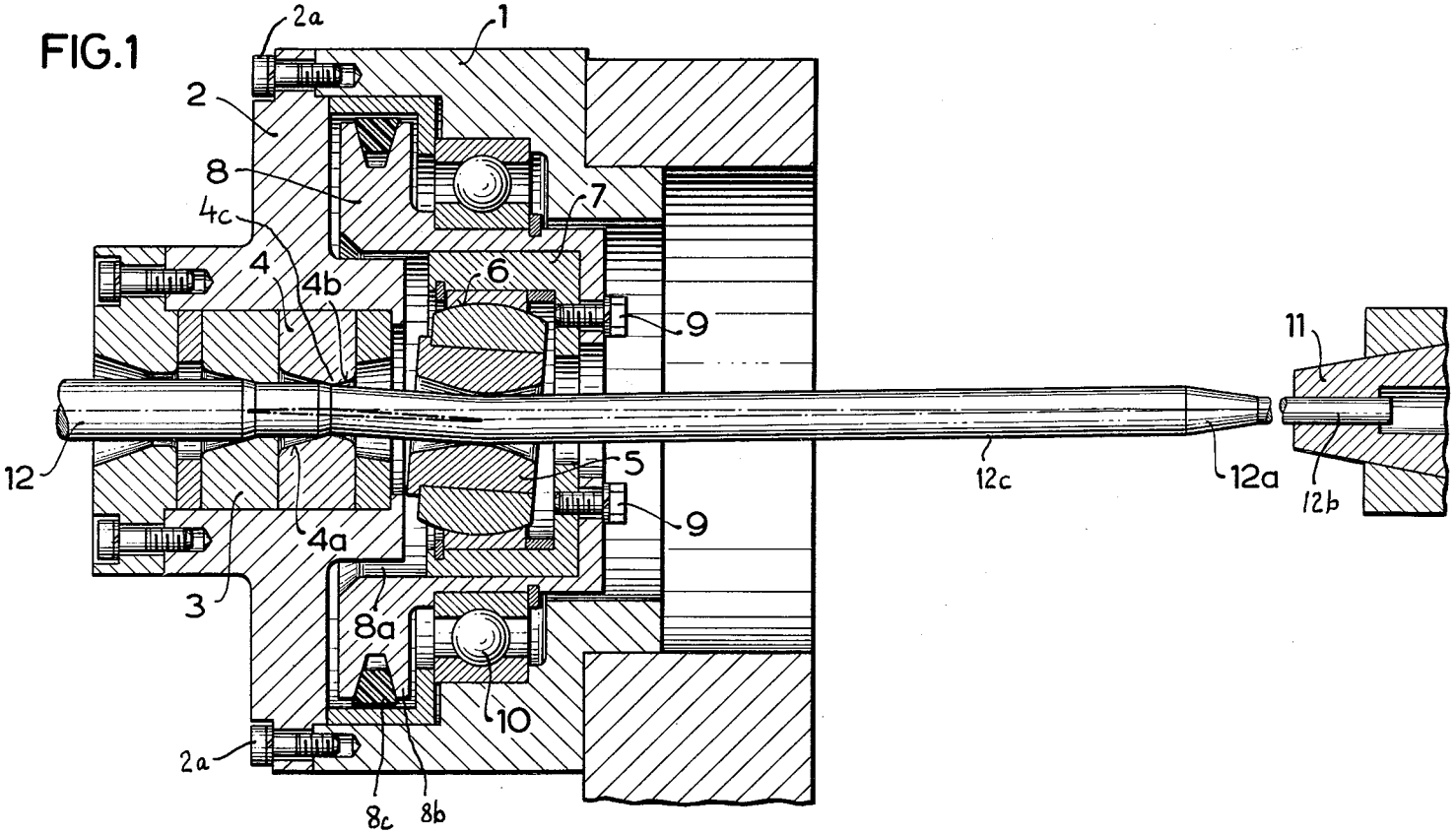
FIG. 1 is a fragmentary axial sectional view of a combined drawing and straightening machine which embodies one form of the invention.

FIG. 1 illustrates a portion of a draw bench having a frame or housing 1 supporting a die holder 2 which is secured thereto by bolts 2*a*. The holder 2 confines a reducing die 4 and a first or sink die 3 serving as a guide for a tubular or rod-shaped metallic workpiece 12. The first die 3 can be replaced by another guide, such as a slide ring, a sleeve (not shown) or a pair of rollers 103 (see FIG. 2).

The reducing die 4 has an internal surface including an inlet portion 4*a* which tapers forwardly toward the throat portion 4*c* and an oppositely inclined outlet portion 4*b* whose diameter increases forwardly (i.e., in a direction away from the throat portion 4*c*). As a rule, the inclination of the surface portion 4*b* is preferably identical with the optimum inclination of that part of the workpiece 12 which advances beyond the throat portion 4*c*.

The main purpose of the first die 3 or analogous guide means for the workpiece 12 is to insure that the axis of that portion of the workpiece which extends between the interior of the die 3 and the throat portion 4*c* of the internal surface of the die 4 is coaxial with the opening of the die.

The straightening means of the draw bench comprises an annular tool 5 which may consist of aluminum bronze or another highly wear-resistant material and is mounted in the frame 1 downstream of the reducing die 4, as considered in the direction of lengthwise movement of the workpiece 12. The straightening tool 5 is a press fit in a spherical bearing 6 which is received in an eccentric bore of a sleeve 7. The latter is mounted in and rotates with a rotary driving member 8 installed in the frame 1 and having an integral or detachable sheave 8*b* receiving torque from a V-belt 8*c*. The sleeve 7 is received in an eccentric bore 8*a* of the driving member 8. The eccentricity of the straightening tool 5 with reference to the reducing die 4 can be adjusted by changing the angular position of the sleeve 7 relative to the driving member 8. The screws 9 are loosened prior to such adjustment and are thereupon tightened to fix the sleeve 7 in the selected position. The shanks of these screws extend through arcuate slots in the bottom wall of the cupped driving member 8. One or more antifriction bearings 10 are interposed between the frame 1 and the driving member 8.

When the belt 8*c* is driven by a suitable motor, not shown, the axis of the passage in the straightening tool 5 orbits about an extension of the axis of the opening in the reducing die 4. The radius of the circle along which the axis of the passage of the tool 5 orbits when the driving member 8 rotates depends on the selected eccentricity of the sleeve 7.

In order to start a drawing operation, the front part or tip 12*a* of the workpiece 12 to be treated is reduced, as at 12*b*, and is engaged by a suitable gripper or tangs 11 which is mounted on a carriage or another suitable draw unit. The straightening operation begins as soon as the reduce portion 12*c* of the workpiece 12 reaches the tool 5 which is assumed to be driven by the member 8 through the medium of the sleeve 7 and bearing 6. The tool 5 flexes the reduced portion 12*c* in a member of different directions and such flexing or bending acts in the plastic region of the material of the workpiece.

The bearing 6 can swivel with the tool about axes which are normal to the axis of the opening in the die 4.

Figure 2:
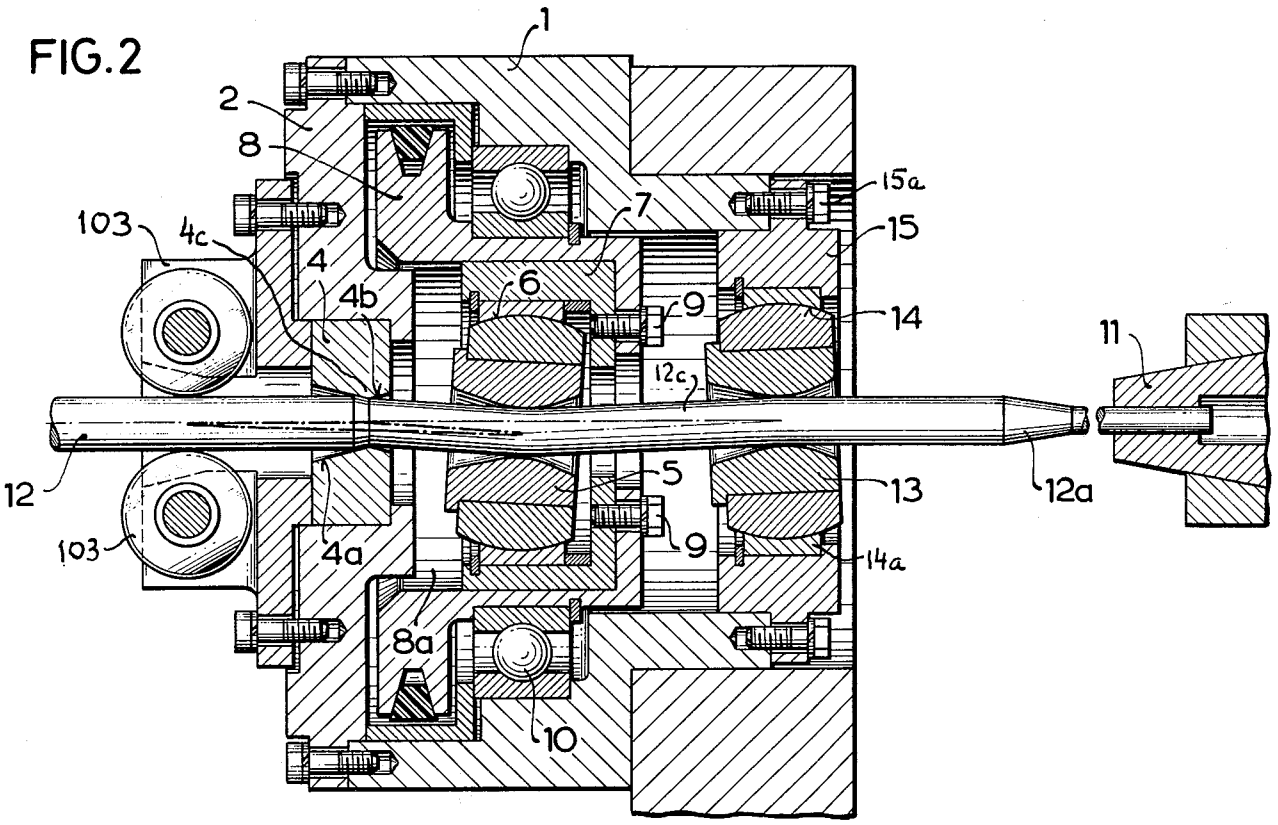
FIG. 2 is a similar fragmentary axial sectional view of a modified machine.

FIG. 2 illustrates a portion of a modified draw bench wherein all such parts which are identical with or clearly analogous to the corresponding parts of the first draw bench are denoted by similar reference characters. The aforementioned roller-shaped guides 103 replace the first die 3 of FIG. 1. The axes of the rollers 103 are normal to and cross in space the axis of the opening in the die 4.

The draw bench of FIG. 2 further comprises means for enhancing the straightening action of the tool 5 by the provision of a second guide 13 which compensates for the fact that the tongs 11 moves away from the straightening tool 5 when the machine is in use. As can be readilly determined by looking at FIG. 1, the inclination of the workpiece portion 12*c* between the tool 5 and tongs 11 will change as the tongs 11 moves away from the frame 1. This cannot happen in the apparatus of FIG. 2 because the inclination of the workpiece portion 12*c* between the parts 5 and 13 cannot be influenced by the distance between the tongs 11 and frame 1. The guide 13 is a ring which is concentric with the reducing die 4 and is mounted in a second spherical bearing 14. The outer race 14*a* of the bearing 14 is mounted in a sleeve 15 which is bolted to the frame 1, as at 15*a*.

The purpose of the bearing 6 (in FIGS. 1 and 2) and of the bearing 14 is to tilt in accordance with the flexure or inclination of the nearest portion of the workpiece and to thus reduce the likelihood of damage to the external surface of the workpiece.

The flexing of workpieces 12 in response to orbiting of the axis of the passage in the tool 5 about the axis of the opening in the die 4 takes place downstream of the throat portion 4*c* of the internal surface of the die 4, i.e., in the region where the material of the workpiece is in a plastic state. The orbiting of the axis of the passage of the straightening tool 5 about the axis of the opening in the die 4 enables the plasticized portion of the workpiece 12 downstream of the reducing die to undergo a large number of flexures in a number of different directions whereby the extent of flexing of the workpiece decreases gradually in a direction toward the tongs 11. As a rule, each increment of the workpiece 12 downstream of the throat portion 4c of the internal surface of the die 4 undergoes at least one plastic flexing and at least on partially plastic counterflexing. This produces a surprisingly satisfactory straightening action which is sufficiently pronounced to allow for automatic transfer of reduced workpieces into next-following machines without any secondary straightening even if the next-following machines are capable of accepting only such workpieces whose axes are straight.

The frictional engagement between the straightening tool 5 and the workpiece 12 is sufficiently pronounced to insure that the tool 5 does not rotate about its own axis, i.e., that the driving member 8 rotates the sleeve 7 relative to the spherical bearing 6 which latter shares the orbital movements of the tool 5. This spherical bearing enables the tool 5 to change its inclination so as to insure that the axis of its passage coincides with that portion of the workpiece 12 therewithin which extends from the throat portion 4c of the internal surface of the die toward the central portion of the passage in the tool 5.

The heavy broken lines denote in FIGS. 1 and 2 the straightening triangles which are defined by the die 4, tool 5 and guide means 3 or 103.

Without further analysis, the foregoing will so fully reveal the gist of the present invention that others can, by applying current knowledge, readily adapt it for various applications without omitting features which fairly constitute essential characteristics of the generic and specific aspects of out contribution to the art and, therefore, such adaptations should and are intended to be comprehended with the meaning and range of equivalence of the claims.

What is claimed as new and desired to be protected by Letters Patent is set forth in the appended claims:

1. In a machine for simultaneous reducing and straightening of elongated tubular or rod-shaped metallic workpieces, a combination comprising a frame; a reducing die mounted in said frame and having a reducing opening for workpieces and a surface surrounding said opening, said surface having a throat portion and an outlet portion which is tapering counter to the direction of the lengthwise movement of workpieces through said die an annular straightening tool movably installed in said frame downstream of said die and having a passage for workpieces; and means for moving said straightening tool relative to said frame so that the axis of said passage orbits about the axis of said opening whereby a workpiece moving lengthwise through said die and said straightening tool is flexed in a plurality of directions in the entire region extending from said die to said straightening tool.

2. A combination as defined in claim 1, further comprising guide means installed in said frame upstream of said die and arranged to prevent flexing of workpieces in the region upstream of said throat portion of said surface.

3. A combination as defined in claim 2, wherein said gudie means comprises a second reducing die.

4. A combination as defined in claim 2, wherein said guide means comprises a plurality of rollers rotatable in said frame about axes which are substantially normal to and cross in space the axis of said opening.

5. A combination as defined in claim 1, further comprising guide means installed in said frame downstream of said tool and having a passage for workpieces, said passage being coaxial with said opening.

6. A combination as defined in claim 1, wherein said means for moving said tool relative to said frame includes a spherical bearing surrounding and secured to said tool, a sleeve having an eccentric bore for said bearing, and drive means for rotating said sleeve.

7. A combination as defined in claim 6, wherein said sleeve is rotatable relative to said bearing so that said tool does not share the rotary movement of said sleeve and said drive means.

8. A combination as defined in claim 1, further comprising means for adjusting the extent of orbital movement of the axis of said passage relative to the axis of said opening.

9. A combination as defined in claim 1, further comprising first and second means for workpieces, said first and second guide means being respectively installed in said frame upstream and downstream of said reducing die and being arranged to maintain the adjacent portions of a workpiece passing therethrough in axial alignment with that portion of the workpiece which passes through said throat portion of said opening.

10. In a machine for simultaneous reducing and straightening of elongated tubular or rod-shaped metallic workpieces, a combination comprising a frame; a reducing die mounted in said frame and having a reducing opening and a surface surrounding said opening, said surface having a throat portion and an outlet portion tapering counter to the direction of lengthwise movement of workpieces through said die; an annular straightening tool movably installed in said frame downstream of said die and having a passage for workpieces; means for moving said tool relative to said frame so that said passage orbits about the axis of said opening whereby a workpiece moving lengthwise through said die and said tool is flexed in a plurality of directions downstream of said throat portion of said opening; guide means installed in said frame downstream of said tool and having a further passage for workpieces, said further passage being coaxial with said opening; and a spherical bearing for said guide means, said spherical bearing being arranged to swivel in said frame about axes which are normal to the axis of said opening.

11. In a machine for simultaneous reducing and straightening of elongated tubular or rod-shaped metallic workpieces, a combination comprising a frame; a reducing die mounted in said frame and having a reducing opening for workpieces and a surface surrounding said opening, said surface having a throat portion and an outlet portion which is tapering counter to the direction of lengthwise movement of workpieces through said die and in which the material is in the plastic state, the taper of the surface of said outlet portion being substantially identical to the inclination of the surface of the workpiece which advances in said outlet portion beyond said throat portion; an annular straightening tool movably installed in said frame downstream of said die and having a passage for workpieces; and means for moving said straightening tool relative to said frame so that the axis of said passage orbits about the axis of said opening whereby a workpiece moving lengthwise through said die and said straightening tool is flexed in a plurality of direction in the entire region extending from said die to said straightening tool.

* * * * *